United States Patent [19]

Auclair

[11] Patent Number: 4,623,204

[45] Date of Patent: Nov. 18, 1986

[54] UNIVERSAL GROUND CLAMP

[76] Inventor: William T. Auclair, Pinney St., R.F.D. #1, Winsted, Conn. 06098

[21] Appl. No.: 737,553

[22] Filed: May 24, 1985

Related U.S. Application Data

[63] Continuation-in-part of Ser. No. 611,315, May 17, 1984, abandoned.

[51] Int. Cl.[4] ..... H01R 4/60

[52] U.S. Cl. ..... 339/14 L; 24/279; 339/251

[58] Field of Search ..... 339/14 R, 14 L, 251; 174/78; 24/279

[56] References Cited

U.S. PATENT DOCUMENTS

| | | | |
|---|---|---|---|
| 1,179,455 | 4/1916 | Pleister | 339/251 |
| 1,205,374 | 11/1916 | Marcus | 24/279 |
| 1,805,754 | 5/1931 | Borden | 339/14 L |
| 1,839,254 | 1/1932 | Pearson et al. | 339/251 |
| 1,864,292 | 6/1932 | Buchanan | 339/251 |
| 1,914,381 | 6/1933 | Olley et al. | 339/251 |
| 1,914,554 | 6/1933 | Borden | 339/251 |
| 1,919,061 | 7/1930 | Hardwick | 339/251 |
| 1,929,374 | 10/1933 | Pearson | 339/251 |
| 1,966,132 | 7/1934 | Pearson | 339/251 |
| 2,696,518 | 12/1954 | Roehmann | 174/78 |
| 3,370,122 | 2/1968 | Ichikawa | 174/78 |
| 3,728,472 | 4/1973 | Leuteritz | 174/78 |
| 3,781,771 | 12/1973 | Blake | 174/78 |
| 3,887,895 | 6/1975 | Pierzchala | 339/14 R |
| 4,080,024 | 3/1978 | Kroon | 339/14 R |
| 4,140,870 | 2/1979 | Volkers et al. | 174/78 |

FOREIGN PATENT DOCUMENTS

| | | | |
|---|---|---|---|
| 681564 | 9/1939 | Fed. Rep. of Germany | 24/279 |

*Primary Examiner*—Neil Abrams

*Attorney, Agent, or Firm*—Prutzman, Kalb, Chilton & Alix

[57] ABSTRACT

A customer-ready universal ground clamp is provided for accommodating either grounding electrodes or ground wires of various sizes or diameters. The clamp includes a strap sub-assembly designed to provide full surface inter-engagement with the electrode as well as effective edge contact therewith. It also includes a single bolt sub-assembly having a contoured fixed platen that assures intimate engagement between the strap sub-assembly and the grounding electrode while at the same time avoiding any marring or gouging of the soft copper strap. The new and improved clamp can be installed without the need for special tools.

20 Claims, 4 Drawing Figures

UNIVERSAL GROUND CLAMP

RELATED APPLICATION

This application is a continuation-in-part of my copending application Ser. No. 611,315 filed May 17, 1984 entitled "GROUND CLAMP" and now abandoned.

BACKGROUND AND SUMMARY OF THE INVENTION

The present invention relates to clamps for connecting or mating a ground wire of an electrical system to a grounding electrode, such as a water pipe or similar conduit, a grounding rod or other grounding member. More particularly it is concerned with a new and improved universal ground clamp that accommodates grounding electrodes and ground wires of various sizes or diameters.

The clamp includes a strap sub-assembly designed so as to provide full surface inter-engagement with the grounding member as well as effective edge contact therewith. The clamp also utilizes a contoured fixed platen on a single bolt to assure intimate and optimum engagement between the strap sub-assembly and the grounded conduit. Beneficially the platen facilitates a tight-fitting connection due to the contoured interrelationship between the strap and the fixed platen. At the same time it avoids any marring or gouging of the soft copper strap while imparting improved torque strength to the connection.

The new and improved clamp of the present invention provides for ease of installation and independent mounting and dismounting of the ground wire of the electrical system or the grounding electrode while at the same time providing a clamp of simple yet efficient and economical design that can be manufactured and installed in a facile manner without the need for special tools. Further the clamp provides automatic alignment between the ground wire and the grounded conduit connected thereto.

Other features and advantages of the present invention will be in part obvious and in part pointed out more in detail hereinafter.

These and related features and advantages are achieved in accordance with the present invention by providing a universal ground clamp consisting essentially of a strap sub-assembly for electrically engaging the grounding electrode and a bolt sub-assembly mounted on the strap sub-assembly and providing electrical contact with the ground wire of an electrical system. The strap sub-assembly includes an elongated flexible strap and a generally U-shaped contact bracket securely and retainably mounting one end of the strap. The bracket is beneficially provided with arcuate contact surfaces that provides excellent electrical contact with the grounding electrode. The portion of the strap adjacent the contact bracket extends tangentially of the contact surfaces to facilitate encirclement of the grounding electrode by the strap sub-assembly and promote the desired contact between the bracket and the grounding pipe.

The bolt sub-assembly of the clamp consists essentially of a single bolt having a fixed land including a rectangular platen intersecting the axis of the bolt at an intermediate position along its length. The platen has a convexly bowed elongated surface facing the lower end of the bolt, the convex surface extending in the transverse dimension of the elongated platen. A wire-receiving aperture is positioned intermediate the convexly bowed surface and the top relatively shorter end of the bolt and has an axis that extends parallel to the axis of the convex surface for receiving the ground wire of the electrical system. A clamping cap mounted on the apertured end of the bolt moves toward the platen for clampably engaging a ground wire positioned within the wire-receiving aperture. The bolt sub-assembly is mounted on the strap sub-assembly so that upon encirclement of the grounding electrode by the elongated strap the contact surfaces of the bracket engage the electrode while a portion of the strap remote from the bracket conformably engages the convexly bowed platen surface. Retaining means are provided on the bolt to draw the platen toward the bracket when securing the clamp to the electrode while additional retaining means are provided and independently operate for urging the clamping cap into clamping engagement with the ground wire positioned within the wire-receiving aperture.

A better understanding of the objects, advantages, features, properties and relationships of the invention will be obtained from the following detailed description and accompanying drawings which set forth an illustrative embodiment and are indicative of the way in which the principles of the invention are employed.

BRIEF DESCRIPTION OF THE DRAWING

In the drawings:

FIG. 1 is a side-elevational view of the clamp of the present invention shown mounted on a grounding electrode of conventional size, such as a water pipe or the like:

DESCRIPTION OF THE PREFERRED EMBODIMENT

Figure 1:
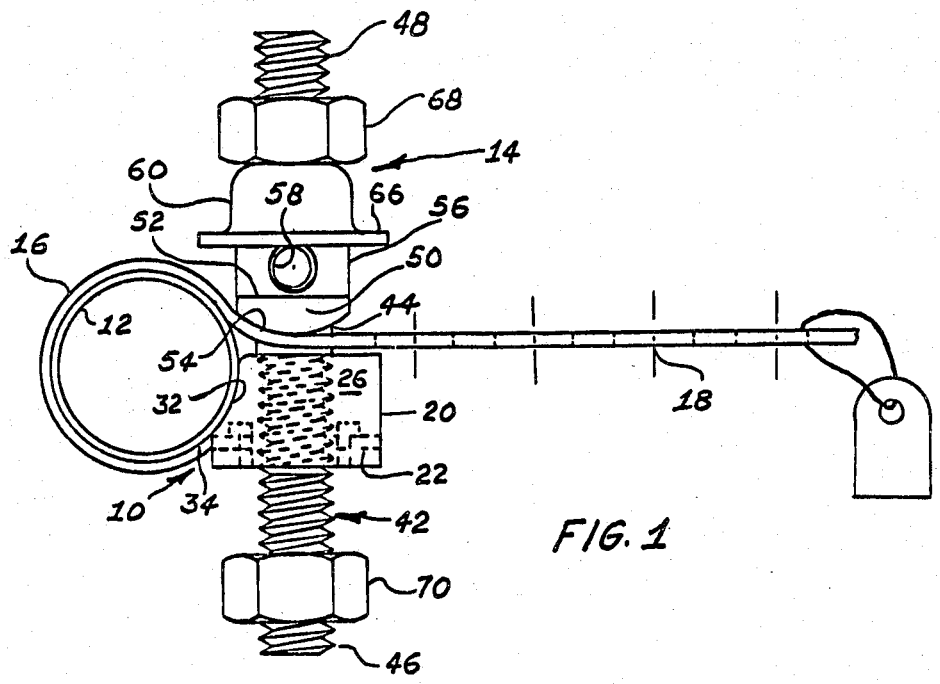
Figure 2:
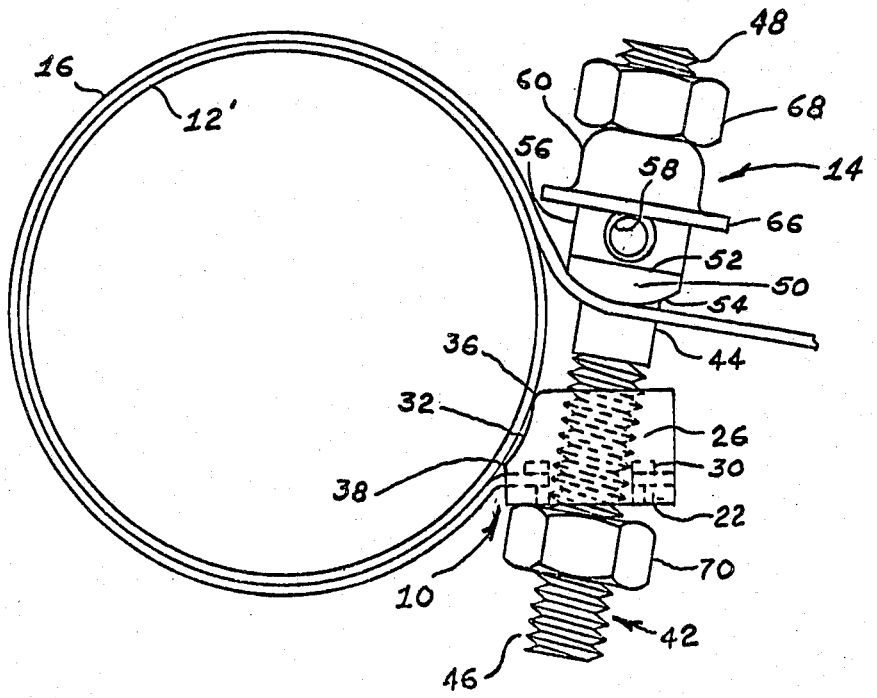
FIG. 2 is a side elevational view similar to FIG. 1 showing the clamp mounted on a substantially larger grounding electrode.
Figure 3:
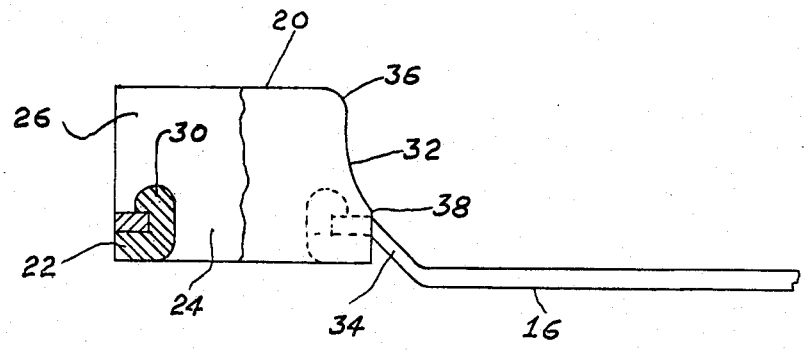
FIG. 3 is a side elevational view, partly broken away and partly in section, of the contact bracket portion of the clamp's strap sub-assembly.
Figure 4:
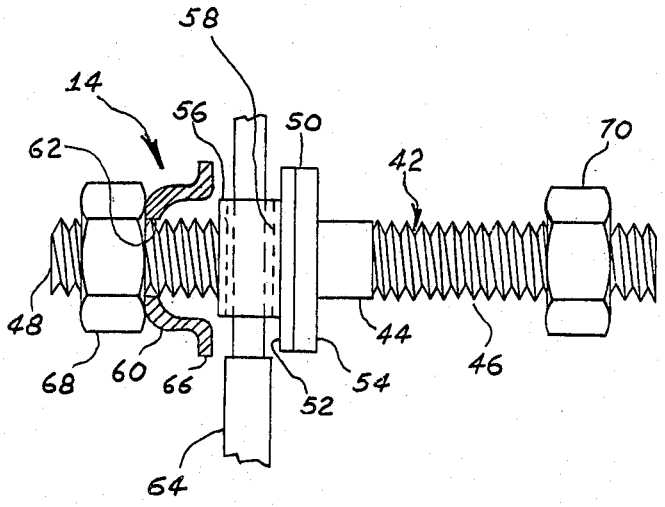
FIG. 4 is a side view, partly in section, of the bolt sub-assembly of the universal ground clamp of the present invention.

Referring now to the drawing in greater detail wherein like reference numerals indicate like parts throughout the several Figures, the universal ground clamp of the present invention is shown in FIGS. 1 and 2 as consisting essentially of a strap sub-assembly, generally designated by the numeral 10, that encircles and electrically engages a grounding electrode 12 such as a water pipe, rod or similar grounding member, and a bolt sub-assembly 14 securing the strap sub-assembly thereto. The strap sub-assembly 10 includes an elongated, ribbon-like, flexible metal strap 16, preferably of copper, having a plurality of circular strap apertures 18 spaced along its entire length and a generally U-shaped contact clip or bracket 20 securely and retainably mounting one end of the strap 16. The U-shaped contact bracket has a planar base portion 22 with a central aperture 24 therein and a pair of up-standing side portions 26 integral with the base portion and disposed in spaced parallel alignment on opposite sides of the base portion. The end of the strap secured to the base portion 22 covers substantially the entire surface of the base portion between the upstanding side portions 26 and is suitably fixedly retained on the base portion, such as by the staked portion 30 of the base defining the central aperture 24. The attached portion 30 securely interlocks the end of the strap to the contact bracket 20 as best shown in FIG. 3, with the remainder of the strap extending forwardly therefrom. Other suitable means known in the art may be used for securing the strap to the bracket; for example a brass grommet or other connector may be employed.

The front edges of the upstanding side portions 26 are provided with an arcuate contour which, as shown in FIGS. 1–3, is concave over a significant portion 32 of each front edge, the radius of the concave portion 32 being substantially identical to the smallest grounding pipe conventionally utilized, that is, of a copper pipe having a diameter of approximately one-half inch. In this manner, full edge contact is provided between the two side portions 26 of the bracket and the grounding electrode conduit 12 when the strap sub-assembly is mounted thereon. This full surface contact is best illustrated in FIG. 1 of the drawing. The full surface contact is also aided by the portion 34 of the strap immediately adjacent the front edge of the contact bracket. As best shown in FIG. 3, that portion 34 of the strap extends forwardly from the bracket 20 tangentially of the concave forwarded side edges 32 of the contact bracket. It also tends to fully conform to the radius of the conventional one-half inch copper tubing 12 used as the grounded conduit.

The concave forward edges of the up-standing side portions 26 of the bracket are further provided with convex portions 36, 38 at the opposite ends of the concave surfaces 32. These convex portions are provided so as to effect a smooth contoured interconnection with the top and bottom edges of the bracket 20. More importantly, however, they provide smooth, non-abrasive yet effective spaced contact points so that when the clamp is mounted on a significantly larger grounding electrode, such as the copper pipe 12' shown in FIG. 2, the convex end portions 36, 38 tend to form a firm positive electrical connection with the pipe 12' without excessive marring or gouging. This is best achieved by using a bracket made of brass or similar material that is harder than the copper pipe. Once again, the tangentially extending portion 34 of the strap assists in providing the point contact between the contact bracket and the grounding electrode.

The clamp of the present invention, as mentioned herein before, further includes a bolt sub-assembly 14 that employs a single bolt 42. The bolt is fully threaded along most of its length with the exception of an intermediate portion or land 44 located at a distance from the lower end thereof that is approximately two-thirds of the length of the bolt. The intermediate portion or land 44 thus defines a long lower or bottom threaded portion 46 and a relatively short upper threaded portion 48. The land 44 is provided with a fixed platen 50 that intersects the axis of the bolt and is essentially perpendicular thereto. The platen 50 consists of a generally rectangular member having elongated top and bottom surfaces 52, 54 respectively. The lower or bottom surface 54 is uniformly convexly bowed in its transverse dimension while the upper or top surface 52 of the generally rectangular platen 50 is substantially flat. The land 44 further includes a sleeve-like boss that extends upwardly from the flat top surface 52 of the platen toward the shorter end 48 of the bolt. The sleeve-like boss 56 is of circular configuration, co-axial with the bolt and of substantially the same diameter as the transverse dimension of the generally rectangular platen 50. A wire-receiving aperture 58 extends fully through both the boss 56 and the bolt 42 immediately adjacent the top flat surface 52 with the axis of the aperture extending along the longitudinal dimension of the rectangular platen 50 and parallel to the axis of the convex lower platen surface 54. The aperture 58 preferably has a diameter large enough to accomodate a ground wire having of a size up to 6 gauge; i.e., slightly large than 0.2 inch.

The bolt sub-assembly 14 further includes a bell-shaped clamping cap 60 having a central aperture 62 in the dome thereof for permitting the cap to slide longitudinally along the top threaded portion 48 of the bolt and brought into clamping engagement with a ground wire 64 positioned within the wire-receiving aperture 58. As shown, the bell-shaped clamping cap terminates in a radially extending lip or flange 66 of sufficient width to provide the requisite clamping action and electrical contact. The dome shape of the clamping cap is of sufficient size so that the cap will fully receive the sleeve-like boss 56 of the land and the radial extending lip 66 of the cap can, if unrestricted, be brought into mating engagement with the flat top surface 52 of the platen. As shown, the clamping cap will be held in its clamping position by a nut 68 threadably mounted on the top threaded end 48 of the bolt.

When mounting the clamp it is preferable, though not absolutely necessary, to mount first the ground wire for the electrical system, telephone system or the like. The wire is simply inserted into the wire-receiving aperture 58 in the boss 56. The clamping cap 60 is brought into engagement with the ground wire and tightened and secured there against by means of the top nut 68 threadably mounted on the bolt. Next the strap 16 is wrapped around the grounded pipe prior to mounting the bolt sub-assembly thereon. Thus, as best shown in FIGS. 1 and 2, the strap sub-assembly is mounted on a copper pipe or other suitable grounding electrode by simply wrapping the elongated strap around the electrode while bringing the front contact edges of the bracket into engagement with the electrode. Thereafter, the lower threaded portion 46 of the bolt sub-assembly is passed through one of the apertures 18 in the elongated strap and through the central aperture 24 in the planar base portion of the bracket 20. In this way, the convex lower surface 54 of the clamping platen 50 is brought into engagement with the strap. This provides a smooth contoured connection with the strap with little or no marring or gouging of the soft copper strap when the bolt sub-assembly is tightened. A nut 70 threaded on the lower portion 46 of the bolt draws the platen 50 toward the bracket 20 so as to securely fasten the clamp to the pipe and assure electrical continuity therebetween. As will be noted, the mounting of the bolt sub-assembly automatically orients the boss' wire-receiving aperture 58 and the ground wire 64 held therein so that the wire extends along an axis parallel to the axis of the grounded conduit.

As can be appreciated, both installation operations can be performed in a rapid and facile manner without the necessity for special tools since both connections can be made hand tight and subsequently tightened further by simply applying a wrench to the nuts 68, 70 on opposite ends of the bolt sub-assembly. Excess strap can be cut away or bent and tagged as shown in FIG. 1. Additionally, if it is subsequently desired to attach more than one ground wire or a larger ground wire, it is not necessary to remove the clamp from the grounding electrode. Rather it is only necessary to loosen the clamping cap and insert the new ground wire or wires into apeture 58 and retighten the nut 68.

As will be apparent to persons skilled in the art, various modifications, adaptations and variations of the foregoing specific disclosure can be made without departing from the teachings of the present invention.

I claim:

1. A universal ground clamp for independent attachment to and release from grounding electrodes and ground wires of different size comprising a strap sub-assembly for electrically engaging the grounding electrode and a bolt sub-assembly mounted on the strap sub-assembly and providing electrical contact with the ground wire of an electrical system, said strap sub-assembly including an elongated flexible strap and a generally U-shaped contact bracket securely and retainably mounting one end of said strap and having arcuate contact surfaces for providing electrical contact with the grounding electrode, the strap portion adjacent said contact bracket extending tagentially of said arcuate contact surfaces, said bolt sub-assembly consisting essentially of a single bolt having a fixed land with a platen intersecting the axis of the bolt at an intermediate position along its length, said platen having an elongated bearing surface facing a first end of the bolt and being convexly bowed in its transverse dimension, a wire-receiving aperture intermediate said bowed surface and a second end of said bolt opposite said first end, said wire-receiving aperture having an axis extending generally parallel to the axis of said convexly bowed surface for receiving the ground wire of an electrical system, a clamping cap mounted on said second bolt end and moveable toward said platen for clampably engaging a ground wire positioned within said wire-receiving aperture and retaining means on said bolt for movement toward said convexly bowed platen surface, said bolt sub-assembly being mounted on said strap sub-assembly upon encirclement of the grounding electrode by the elongated strap whereby the contact surfaces of the strap remote from the bracket conformably engages the convexly bowed bearing surface.

2. The clamp of claim 1 wherein said platen is generally rectangular and said land includes a sleevelike boss with said wire-receiving aperture extending therethrough.

3. The clamp of claim 1 wherein said platen is generally rectangular and the axis of said wire-receiving aperture extends along the longitudinal dimension of said platen.

4. The clamp of claim 1 wherein said retaining means includes first retaining means on said first bolt end independently operable to draw said platen portion toward said bracket when securing the clamp to a grounding electrode and second retaining means on said second bolt end independently operable for urging said clamping cap into clamping engagement with a ground wire within said wire-receiving aperture.

5. The clamp of claim 1 wherein said contact bracket has a planar base portion and a pair of upstanding side portions carrying said contact surfaces, said base portion securely and retainably mounting one end of said strap such that said strap extends forwardly therefrom tagentially of said contact surfaces.

6. The clamp of claim 5 wherein said side portions each have an upstanding forward edge with a radius of curvature sufficient to provide full surface contact with a grounding electrode of cylindrical design and with opposite ends of said concave edges being convex to provide multiple point contact with relatively larger diameter grounding electrodes.

7. The clamp of claim 1 wherein said bracket includes planar base portion retainably mounting one end of said strap whereby said strap extends forwardly therefrom, said base portion having an aperture therein for mounting said bolt sub-assembly.

8. The clamp of claim 7 wherein said first bolt end extends through the aperture in the bracket base portion and said retaining means includes means operable to draw said platen toward said bracket when securing the clamp to the grounding electrode.

9. The clamp of claim 1 wherein said elongated strap is of flexible metal and has a plurality of strap apertures spaced along the length thereof, said first bolt end extending through both a strap aperture in said remote strap portion and said bracket, said retaining means including means operable to draw said platen toward said bracket when securing the clamp to the grounding electrode.

10. The clamp of claim 1 wherein said platen is generally rectangular and said land includes a cylindrical sleeve-like boss coaxial with said bolt, said wire-receiving aperture extending through both the boss and the bolt with its axis extending along the longitudinal dimension of the rectangular platen.

11. The clamp of claim 1 wherein said contact bracket has a planar base portion and a pair of upstanding side portions, said base portion securely and retainably mounting one end of said strap such that said strap extends forwardly therefrom, said base portion having an aperture therein for mounting said bolt sub-assembly, said side portions each having a concave forward edge with a radius of curvature sufficient to provide full surface contact with a grounding electrode of cylindrical design and with opposite ends of said concave edges being convex to provide multiple point contact with relatively larger diameter grounding electrodes, said first bolt end extending through the aperture in the bracket base portion, said retaining means including means operable to draw said platen toward said bracket when securing the clamp to the grounding electrode.

12. A universal ground clamp for independent attachment to and release from grounding electrodes and ground wires of different size comprising a strap sub-assembly for encircling and electrically engaging the grounding electrode and a bolt sub-assembly mounted on the strap sub-assembly and providing electrical contact with the ground wire of an electrical system, said strap sub-assembly including an elongated flexible metal strap having a plurality of strap apertures spaced along the length thereof and a generally U-shaped contact bracket having a planar base portion and a pair of upstanding side portions, said base portion securely and retainably mounting one end of said strap such that said strap extends forwardly therefrom, said base portion having an aperture therein for mounting said bolt sub-assembly, said side portions each having a concave forward edge with a radius of curvature sufficient to provide full surface contact with a grounding electrode of cylindrical design and with opposite ends of said concave edges being convex to provide multiple point contact with relatively larger diameter grounding electrodes, said strap adjacent said contact bracket extending tagentially of the concave forward edges of said side portions, said bolt sub-assembly consisting essentially of a single bolt having a generally rectangular fixed land with a platen intersecting the axis of the bolt at an intermediate position along its length, said platen having an elongated bearing surface facing a first end of the bolt and being convexly bowed in its transverse dimension, said bolt having a wire-receiving aperture intermediate said bowed surface and a second end of said bolt opposite said first end, said wire-receiving aperture having an axis extending along the longitudinal dimension of the platen bearing surface and parallel to the axis of the grounding electrode for receiving the ground wire of an electrical system, a clamping cap mounted on said second bolt end and moveable toward said platen for clampably engaging said ground wire positioned within said wire-receiving aperture and retaining means on said bolt for movement toward said convexly bowed platen surface, said bolt sub-assembly being mounted on said strap sub-assembly whereby upon encirclement of the grounding electrode by the elongated strap the upstanding side portions of the bracket engage the grounding electrode and a portion of the strap remote from the bracket conformably engages the convexly bowed platen surface, said first bolt end extending through both a strap aperture in said remote strap portion and the aperture in the bracket base portion.

13. The conduit of claim 12 wherein said land includes a cylindrical sleeve-like boss coaxial with said bolt, said wire-receiving aperture extending through both the boss and the bolt for receiving the ground wire of an electrical system.

14. The clamp of claim 12 wherein said retaining means includes first retaining means on said first bolt end independently operable to draw said platen toward said bracket when securing the clamp to the grounding electrode and second retaining means on said second bolt end independently operable for urging said clamping cap into clamping engagement with a ground wire positioned within said wire-receiving aperture.

15. A universal ground clamp for attachment to a grounding electrode and ground wire, comprising elongated strap means having an elongated, flat strap adapted to be wrapped about a grounding electrode to electrically connect the strap means to the electrode, said strap means, including the flat strap, having a plurality of longitudinally spaced apertures therealong to present a pair of generally opposed apertures in opposed segments of said strap means, including at least one segment of the flat strap, when the flat strap is wrapped about a grounding electrode, and a clamping fastener sub-assembly comprising an elongated threaded stud portion adapted to be received within a said pair of generally opposed apertures of the strap means with the flat strap so wrapped about a grounding electrode, and a pair of longitudinally spaced clamping head means on the stud portion having opposed inner faces for engaging said opposed segments of the strap means to claim the strap means to a grounding electrode, at least one of the clamping head means having at least a portion thereof threadably mounted on the threaded stud portion to selectively vary the distance between the clamping head means by relative rotation of the stud portion and said one clamping head means, thereby to selectively tighten and loosen the fastener sub-assembly, at least the other clamping head means having a rigid shoe portion with a said inner face with a convex, arcuate shape for engaging said one segment of the flat strap and forming said one segment into a conforming arcuate shape as the fastener sub-assembly is tightened to clamp the strap means to a grounding electrode, said convex, arcuate inner face of said shoe portion having a continuous convex curvature which extends in the direction of the flat strap, toward the grounding electrode when the flat strap is wrapped thereabout, from at least the centerline of said elongated stud portion, so that said one segment of the flat strap engaged by said inner face of said shoe portion is engaged along said continuous arcuate curvature of said shoe portion from at least approximately said centerline to minimize localized variation in stress in said strap segment, said other clamping head means having a transverse opening for receiving a ground wire and ground wire clamping means for clamping a ground wire within said transverse opening.

16. A universal ground clamp according to claim 15 wherein said shoe portion of said other clamping head means is fixed to the stud portion.

17. A universal ground clamp according to claim 15 wherein said ground wire clamping means provides for clamping a ground wire within said transverse opening after the fastener assembly is tightened to clamp the strap means to a grounding electrode.

18. A universal ground clamp according to claim 15 wherein said ground wire clamping means provides for clamping a ground wire within said transverse opening separately from said relative rotation of the stud portion and said one clamping head means.

19. In a ground clamp having elongated strap means with an elongated flat strap adapted to be wrapped about a grounding electrode to electrically connect the strap means to the electrode, said strap means, including the flat strap, having a plurality of longitudinally spaced apertures therealong to present a pair of generally opposed apertures in opposed segments of said strap means, including at least one segment of the flat strap, when the flat strap is wrapped about a grounding electrode, and a clamping fastener sub-assembly comprising an elongated threaded stud portion adapted to be received within a said pair of generally opposed apertures of the strap means with the flat strap so wrapped about a grounding electrode, and a pair of longitudinally spaced clamping head means on the stud portion having opposed inner faces for engaging said opposed segments of said strap means to clamp the strap means to a grounding electrode, at least one of the clamping head means being threadably mounted on the threaded stud portion to selectively vary the distance between the clamping head means, by relative rotation of the stud portion and said one clamping head means thereby to selectively tighten and loosen the fastener sub-assembly, the improvement wherein at least one of the clamping head means has a rigid shoe portion with a said inner face with a convex, arcuate shape for engaging said one segment of the flat strap and forming said one segment into a conforming arcuate shape as the fastener sub-assembly is tightened to clamp the strap means to a grounding electrode, said convex, arcuate inner face of said shoe portion having a continuous convex curvature which extends in the direction of the flat strap, toward the grounding electrode when the flat strap is wrapped thereabout, from at least the centerline of said elongated stud portion, so that said one segment of the flat strap engaged by said inner face of said shoe portion is engaged along said continuous arcuate curvature of said shoe portion from at least approximately said centerline to minimize localized variation in stress in said strap segment.

20. In a ground clamp having elongated strap means with an elongated flat strap adapted to be wrapped about a grounding electrode to electrically connect the strap means to the electrode, said strap means, including the flat strap, having a plurality of longitudinally spaced apertures therealong to present a pair of generally opposed apertures in opposed segments of said strap means, including at least one segment of the flat strap, when the flat strap is wrapped about a grounding electrode, and a clamping fastener sub-assembly comprising an elongated stud portion adapted to be received within a said pair of generally opposed apertures of the strap means with the flat strap so wrapped about a grounding electrode, and a pair of longitudinally spaced clamping head means on the stud portion having opposed inner faces for engaging said opposed segments of said strap means to clamp the strap means to a grounding electrode, at least one of the clamping head means being mounted on the stud portion to selectively vary the distance between the clamping head means, thereby to selectively tighten and loosen the fastener sub-assembly, the improvement wherein at least one of the clamping head means has a rigid shoe portion with a said inner face with a convex, arcuate shape for engagement with said one segment of the flat strap to form said one segment into a conforming arcuate shape as the fastener sub-assembly is tightened to clamp the strap means to a grounding electrode, said convex, arcuate inner face of said shoe portion having a continuous convex curvature which extends in the direction of the flat strap and which is generally symmetrical about the centerline of said elongated stud portion so that said one segment of the flat strap engaged by said inner face of said shoe portion is engaged along said continuous arcuate curvature of said shoe portion from at least approximately said centerline to minimize localized variation in stress in said strap segment.

* * * * *